US009382832B2

(12) United States Patent
Bowers

(10) Patent No.: US 9,382,832 B2
(45) Date of Patent: Jul. 5, 2016

(54) SENSOR HEAT SHIELD STRUCTURE FOR A VEHICLE EXHAUST SYSTEM

(71) Applicant: Honda Motor Co., Ltd., Tokyo (JP)

(72) Inventor: Lee N. Bowers, Springfield, OH (US)

(73) Assignee: Honda Motor Co., Ltd., Tokyo (JP)

( * ) Notice: Subject to any disclaimer, the term of this patent is extended or adjusted under 35 U.S.C. 154(b) by 189 days.

(21) Appl. No.: 14/255,031

(22) Filed: Apr. 17, 2014

(65) Prior Publication Data

US 2015/0300233 A1 Oct. 22, 2015

(51) Int. Cl.

| | |
|---|---|
| ***F01N 3/02*** | (2006.01) |
| ***F01N 13/00*** | (2010.01) |
| ***F01N 13/14*** | (2010.01) |

(52) U.S. Cl.

CPC ..... *F01N 13/008* (2013.01); *F01N 13/14* (2013.01); *F01N 2260/20* (2013.01)

(58) Field of Classification Search

CPC ..... F01N 5/02; F01N 2240/02; F01N 3/043; F01N 13/14; F01N 13/008; F01N 13/102; F01N 13/141; F01P 2060/16; F05D 2240/15; F05D 2260/20; B60K 13/04

USPC ..... 60/320, 295

See application file for complete search history.

(56) References Cited

U.S. PATENT DOCUMENTS

| | | | | |
|---|---|---|---|---|
| 1,814,283 | A | 10/1928 | Braner | |
| 3,863,936 | A | 2/1975 | Farnam et al. | |
| 4,072,316 | A | 2/1978 | Decker et al. | |
| 4,597,850 | A | 7/1986 | Takahasi et al. | |
| 5,174,612 | A | 12/1992 | Schnell | |
| 5,544,902 | A | 8/1996 | Belter | |
| 5,791,660 | A | 8/1998 | Belter | |
| 5,832,723 | A * | 11/1998 | Iwata | F01N 13/008 204/424 |
| 6,266,997 | B1 | 7/2001 | Nelson | |
| 6,386,593 | B1 | 5/2002 | Slais et al. | |

(Continued)

FOREIGN PATENT DOCUMENTS

| | | | |
|---|---|---|---|
| EP | 2037161 | 3/2009 | |
| GB | WO 2013160634 A1 * | 10/2013 | F01N 3/2892 |

(Continued)

OTHER PUBLICATIONS

Machine Translation of JP-2002-285838, Translated on Dec. 14, 2014.*

(Continued)

*Primary Examiner* — Patrick Maines

(74) *Attorney, Agent, or Firm* — Rankin, Hill & Clark LLP

(57) ABSTRACT

An exhaust system includes an exhaust pipe and a heat insulating cover surrounding an outer surface of the exhaust pipe. The cover includes a planar section defining a surface area. An inner surface of the planar section is spaced from the outer surface to define a gap there between. A separate reinforcement is mounted to the planar section. A mounting boss provided in the gap is in direct contact with the inner surface. An exhaust constituent sensor is mounted to the exhaust pipe. A distal end portion of the sensor is received in the mounting boss and projects through an opening in the outer surface and into an exhaust passage. The direct contact of the mounting boss with the inner surface forms a mechanical seal preventing high temperature air from around the exhaust pipe from flowing toward a proximal end portion of the sensor.

19 Claims, 6 Drawing Sheets

(56) References Cited

U.S. PATENT DOCUMENTS

| | | | | |
|---|---|---|---|---|
| 6,843,105 | B1 | 1/2005 | France | |
| 6,845,984 | B2 | 1/2005 | Doyle | |
| 7,374,175 | B2 | 5/2008 | Beutter et al. | |
| 7,434,448 | B2 | 10/2008 | Weyl et al. | |
| 8,225,602 | B2 * | 7/2012 | Cavanagh | F01N 3/2066 60/295 |
| 2003/0006301 | A1 * | 1/2003 | Sugaya | F01N 13/008 239/129 |
| 2004/0074284 | A1 | 4/2004 | Day et al. | |
| 2006/0272944 | A1 | 12/2006 | Ichiyanagi et al. | |
| 2008/0211191 | A1 | 9/2008 | Nakagawa et al. | |
| 2013/0008528 | A1 * | 1/2013 | Mitsuda | F01N 3/0211 137/343 |
| 2013/0213130 | A1 | 8/2013 | Ohmiya et al. | |

FOREIGN PATENT DOCUMENTS

| | | | | |
|---|---|---|---|---|
| JP | 07071243 | A | * | 3/1995 |
| JP | 08189351 | A | * | 7/1996 |
| JP | 08246863 | A | * | 9/1996 |
| JP | 09021315 | A | * | 1/1997 |
| JP | 2002285838 | A | * | 10/2002 |
| JP | 2012172602 | A | * | 9/2012 |
| WO | 2004109270 | | | 12/2004 |

OTHER PUBLICATIONS

Website: "Street Brawler Installation Instructions" http://www.koracing.net/viewarticle.php?article=1, printed Dec. 18, 2013.

* cited by examiner

SENSOR HEAT SHIELD STRUCTURE FOR A VEHICLE EXHAUST SYSTEM

BACKGROUND

Exhaust constituent sensors have been used for many years in vehicles to sense the presence of constituents in exhaust gasses (e.g., oxygen, hydrocarbons, nitrous oxides) and to sense, for example, when an exhaust gas content switches from rich to lean or lean to rich. Because exhaust constituent sensors are mounted to components of the vehicle exhaust flow system, the sensors must be durable and the sensors must be able to operate in a high temperature environment without being damaged by exposure to such high temperatures. The exhaust constituent sensors are typically installed in an exhaust pipe which is part of the vehicle's exhaust flow system and more specifically, the exhaust constituent responsive end of the sensor is disposed within an opening in the exhaust pipe so that exhaust gasses flow into the sensor and the level of the exhaust constituent to be sensed is communicated to a control system of the vehicle.

Due to the ramping up of emissions regulations related to off road recreational vehicles there has been an increase in applications of exhaust constituent sensors, particularly oxygen sensors, to these types of vehicles. Although all-terrain vehicles (ATVs) and multi-utility vehicles (MUVs) use engines very similar in type and layout to motorcycle engines, where the application of emissions equipment is well established, the exhaust systems used for such off road recreational vehicles differs in that the exhaust system is typically enclosed inside the body work of the vehicle. Furthermore, the body work is often plastic and requires special attention to dissipation of the heat generated by the exhaust system. Not only does the body work need protection from the heat generated by the exhaust system, the layout of the body work can also retain heat inside the body work thereby causing an increase in component temperatures. The exhaust constituent sensor is one of the components that need special care to prevent it from over heating. By way of example, a probe end of an oxygen sensor is subjected to the exhaust gas stream, and the heat from the exhaust gas is transferred by conduction along a body of the oxygen sensor. At the other end of the oxygen sensor are wires insulated with a plastic coating which can be adversely affected by the high temperatures generated by the exhaust system.

BRIEF DESCRIPTION

In accordance with one aspect, an exhaust system for a vehicle comprises an exhaust pipe having an outer surface. A heat insulating cover is mounted to the exhaust pipe and configured to at least partially surround the outer surface of the exhaust pipe. The heat insulating cover includes a body having a planar section defining a surface area. The planar section has an inner surface spaced from the outer surface of the exhaust pipe to define a gap there between. A mounting boss is provided in the gap and is in direct contact with the inner surface of the planar section. An exhaust constituent sensor is releasably mounted to the exhaust pipe. A distal end portion of the exhaust constituent sensor is received in the mounting boss and projects through an opening in the outer surface of the exhaust pipe and into a passage of the exhaust pipe. The direct contact of the mounting boss with the inner surface of the planar section forms a mechanical seal preventing high temperature air from around the exhaust pipe from flowing toward a proximal end portion of the exhaust constituent sensor.

In accordance with another aspect, an exhaust system for a vehicle comprises an exhaust pipe having an outer surface. A heat insulating cover is mounted to the exhaust pipe and configured to at least partially surround the outer surface of the exhaust pipe. A mounting boss interconnects the heat insulating cover and the outer surface of the exhaust pipe. The mounting boss includes a first end portion and a second end portion. The first end portion has an annular flange in direct contact with an inner surface of the cover and surrounding a hole located in the cover. The second end portion is dimensioned to be received in an opening located in the outer surface of the exhaust pipe. The direct contact of the annular flange with the inner surface forms a metal to metal mechanical seal between the mounting boss and the heat insulating cover. The mechanical seal transfers heat generated by the exhaust pipe by conduction to the heat insulating cover, and the cover acts as a heat sink absorbing and dissipating the transferred heat into an associated surrounding environment.

In accordance with yet another aspect, an exhaust system for a vehicle comprises a heat insulating cover mounted to an exhaust pipe. A mounting boss is located between an inner surface of the cover and an outer surface of the exhaust pipe. The mounting boss includes a first end portion having an annular flange in direct contact with the inner surface of the cover and a second end portion dimensioned to be received in an opening located in the outer surface of the exhaust pipe. An exhaust constituent sensor is mounted directly to the mounting boss. A surface of the annular flange in direct contact with the inner surface of the heat insulating cover extends parallel to the inner surface to define a continuous metal to metal contact such that the annular flange prevents a flow of high temperature air generated by the exhaust system toward the exhaust constituent sensor. The annular flange further transfers heat generated by the exhaust pipe by conduction to the heat insulating cover. The heat insulating cover acts as a heat sink absorbing and dissipating the transferred heat into an associated surrounding environment.

DETAILED DESCRIPTION

It should, of course, be understood that the description and drawings herein are merely illustrative and that various modifications and changes can be made in the structures disclosed without departing from the present disclosure. In general, the figures of the exemplary exhaust sensor heat shield structure are not to scale. It will also be appreciated that the various identified components of the exemplary sensor heat shield structure disclosed herein are merely terms of art that may vary from one manufacturer to another and should not be deemed to limit the present disclosure.

Figure 1:
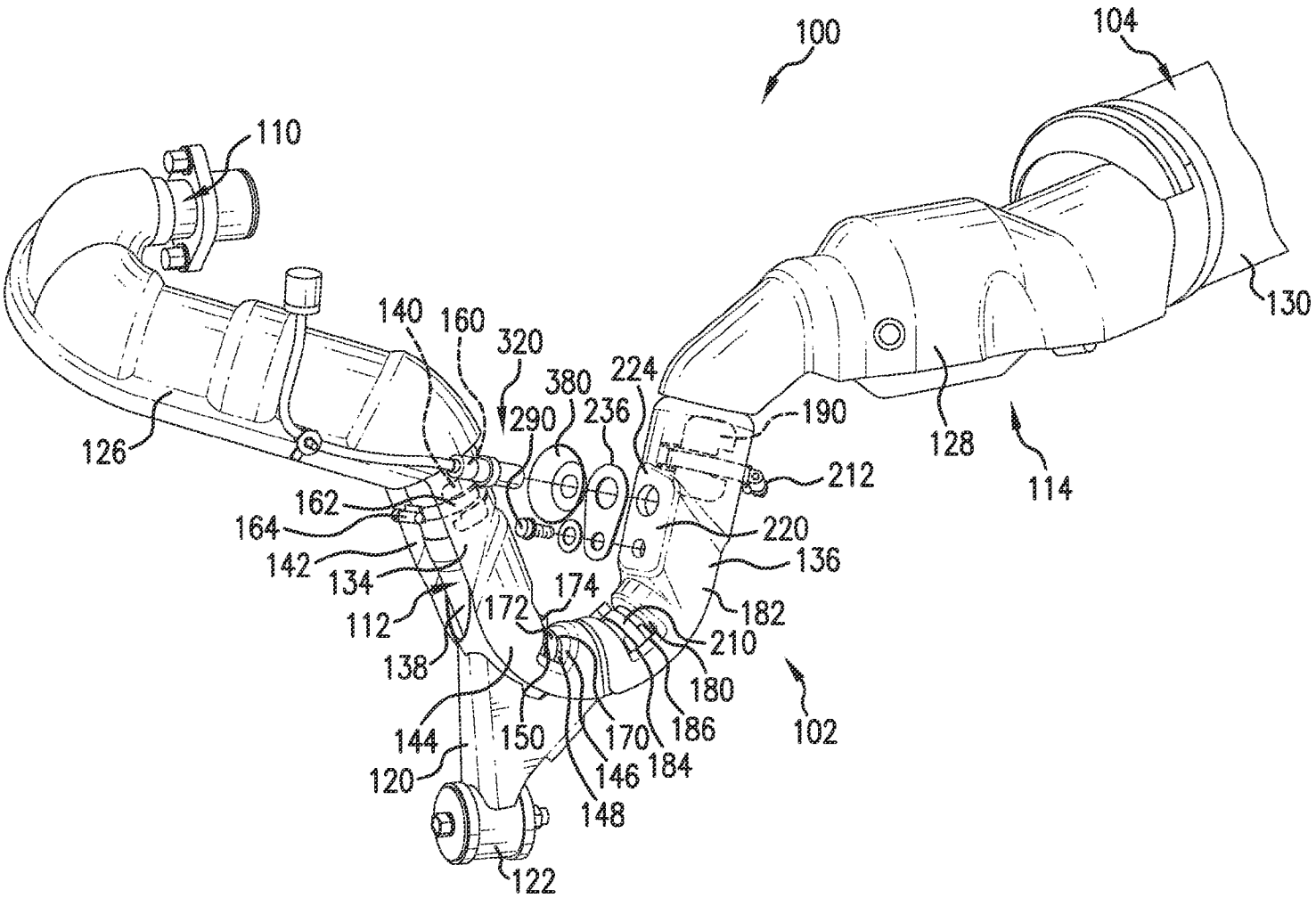
FIG. 1 is a partially exploded perspective view of a vehicle exhaust system according to the present disclosure.
Figure 2:
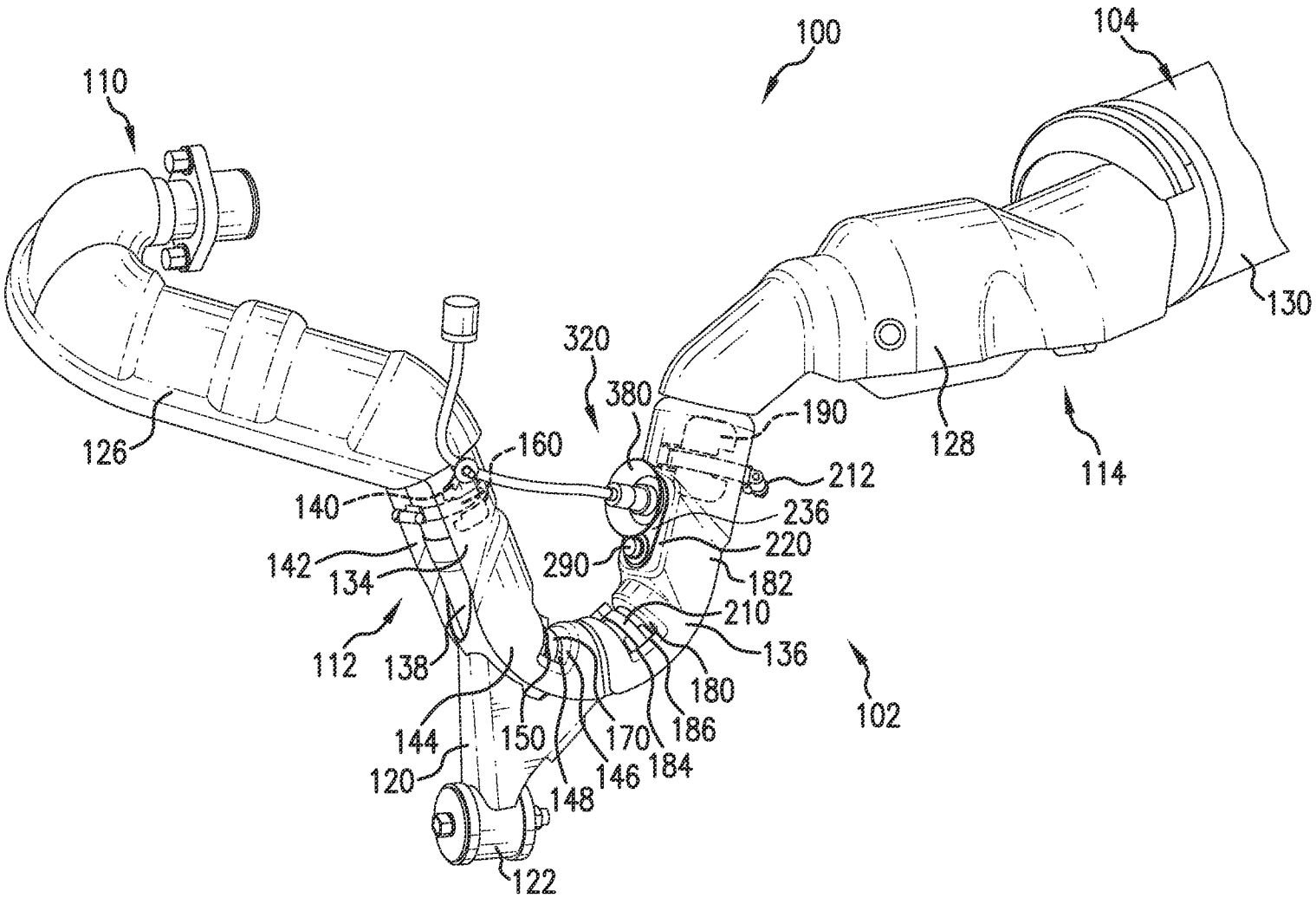
FIG. 2 is a fully assembled perspective view of the vehicle exhaust system of FIG. 1.

Referring now to the drawings, wherein like numerals refer to like parts throughout the several views, FIGS. 1 and 2 illustrate an exhaust system 100 for a vehicle, such as, for example, an off road recreational vehicle, according to the present disclosure. The exhaust system 100 includes an exhaust unit 102 configured to be connected at an upstream end to a vehicle engine (not shown) and at a downstream end to a muffler or silencer 104. In the depicted embodiment, the exhaust unit 102 has a forward exhaust pipe 110, a middle exhaust pipe or connection pipe 112 and a rear exhaust pipe 114. The forward exhaust pipe 110 is a substantially a U-shaped pipe connected at its upstream end to the vehicle engine and curved so as to extend rearwardly from the vehicle engine. The rear exhaust pipe 114 is connected at its upstream end through the connection pipe 112 to the downstream end of the forward exhaust pipe 110, and extends rearwardly therefrom. The connection pipe 112 is also a substantially U-shaped pipe and is curved downwardly relative to the forward and rear exhaust pipes 110, 114. The silencer 104 is connected at its upstream end to the downstream end of the rear exhaust pipe 20. A bracket 120 having a body mount 122 connected thereto is fixed to the connection pipe 112.

A forward heat insulating shield or cover 126 is fixed to an outer surface of the forward exhaust pipe 110 and is configured to at least partially surround the outer surface of the forward exhaust pipe 110. Similarly, the rear exhaust pipe 114 and the silencer 104 are each covered with heat insulating shields or covers 128, 130, respectively. The rear heat resisting cover 128 is also fixed to an outer surface of the rear exhaust pipe and is configured to at least partially surround the outer surface of the rear exhaust pipe 114. Each of the forward heat insulating cover 126 and the rear heat insulating cover 128 can be mounted to the respective forward exhaust pipe 110 and rear exhaust pipe 114 by any mechanical means known in the art, such as, but not limited, to clamps (not shown, similar to the clamps described below).

With continued reference to FIGS. 1 and 2, the exhaust connection pipe 112 can be covered by a pair of heat insulating shields or covers, namely a first heat insulating shield or cover 134 and a second heat insulating shield or cover 136. Each of the heat insulating covers 134, 136 is fixed to an outer surface 138 of the connection pipe 112 and is configured to at least partially surround the outer surface 138 of the connection pipe 112. Further an upstream end of the first heat insulating cover 134 can at least partially cover the downstream end of the forward exhaust pipe 110 and a downstream end of the second heat insulating cover 136 can at least partially cover the upstream end of the rear exhaust pipe 114.

To connect the first heat insulating cover 134 to the connection pipe 112, a mounting bracket or stay 140 is secured (e.g., welded) to an inner surface 142 of a body 144 of the first heat insulating cover 134 adjacent the upstream end of the first heat insulating cover 134. The stay 140 can be configured so as to be curved to partially surround the outer surface 138 of the connection pipe 112. A recessed portion 146 is formed at the downstream end of the body 144 of the first heat insulating cover 134. Openings or slots are provided at opposed ends of the recessed portion 146 (only opening 148 at end 150 of the recessed portion 146 is depicted). A vibration isolating member (not shown) can be positioned between each of the stay 140 and the recessed portion 146 and the outer surface 138 of the connection pipe 112. A clamp 160 surrounds the stay 140 and a portion of the outer surface 138 of the connection pipe 112. The clamp 160 includes of a band 162 and a tightening section 164 for tightening the band 162. Similarly, a clamp 170 surrounds the recessed portion 146 and a portion of the outer surface 138. The clamp 170 includes a band 172 to be threaded through the openings of the recessed portion 164 and a tightening section 174 for tightening the band 172. By tightening the bands 162, 172 of the clamps 160, 170, the first heat insulating cover 134 is secured to the connection pipe 112.

Figure 5:
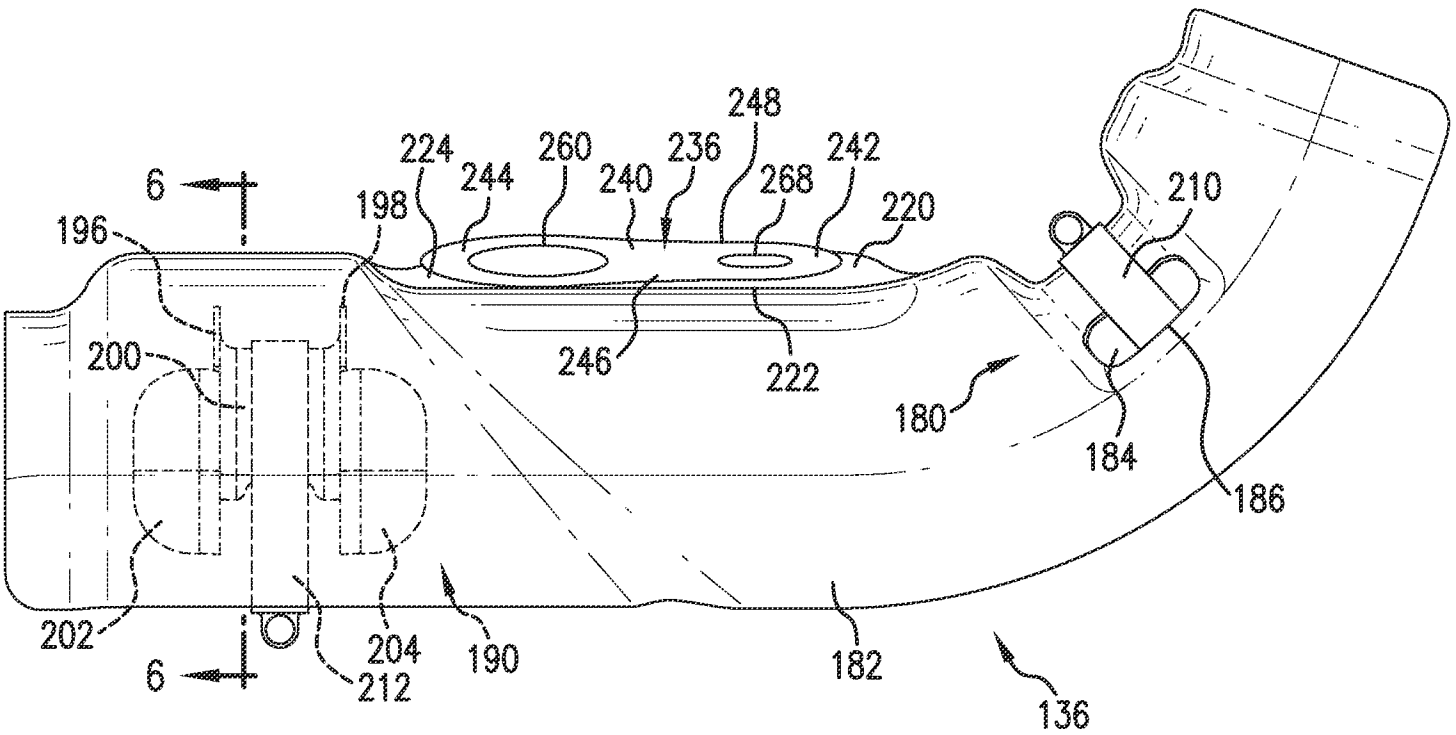
FIG. 5 is a perspective view of a cover of the vehicle exhaust system of FIG.
Figure 6:
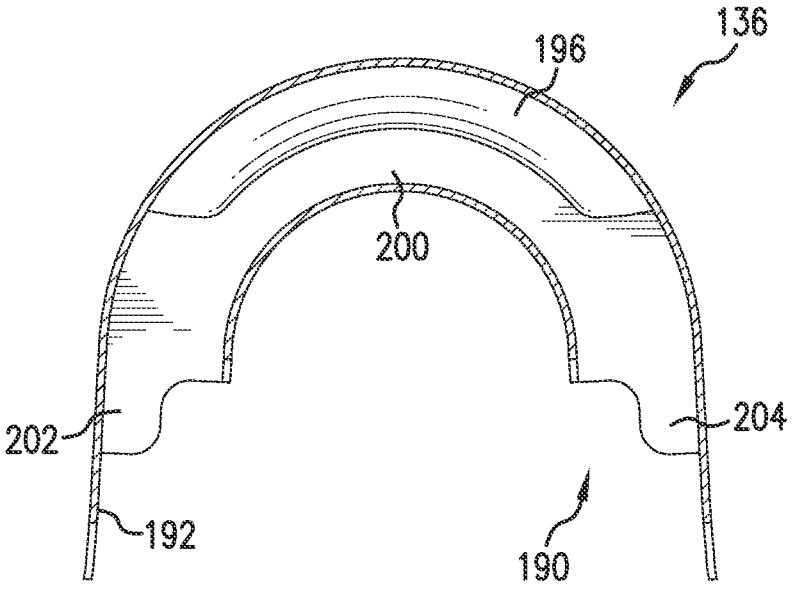
FIG. 6 is a cross-sectional view taken along line 6-6 of the cover of FIG. 5.

The second heat insulating cover 136 is connected to the connection pipe 112 in a similar manner. As best depicted in FIGS. 5 and 6, a recessed portion 180 is formed at the upstream end of a body 182 the second heat insulating cover 136. Openings or slots are provided at opposed ends of the recessed portion 180 (only opening 184 at end 186 of the recessed portion 180 is visible). A mounting bracket or stay 190 is secured (e.g., welded) to an inner surface 192 of the body 182 of the second heat insulating cover 136 adjacent the downstream end of the second heat insulating cover 136. The stay 190 includes a pair of side plate portions 196, 198 opposed to each other along a plane orthogonal to a longitudinal axis of the connection pipe 112, a supporting plate portion 200 connecting the inner ends of the side plate portions 196, 198 so as to be curved to partially surround the outer surface 138 of the connection pipe 112, and a pair of mounting plate portions 202, 204 connected to the outer ends of the side plate portions 196, 198 so as to make contact with the inner surface 192 of the second heat insulating cover 136. The mounting plate portions 202, 204 can be welded to the inner surface 192. It should be appreciated that the stay 140 secured to the first heat insulating cover 134 can have a configuration similar to the stay 190. Clamps 210, 212, which are similar to clamps 160, 170, can be used to secure the recessed section 180 and stay 190 of the second heat insulating cover 136 to the connection pipe 112. Further, a vibration isolating member (not shown) can be sandwiched between the outer surface 138 of the connection pipe 112 and each of the recessed portion 180 and the supporting plate portion 200 of the stay 190.

With reference back to FIGS. 4 and 5, the body 182 of the second heat insulating cover 136 has a planar section 220, which can be located between the recessed portion 180 and the stay 190 secured to the inner surface 192 such that the recessed portion 180 is adjacent one end of the planar section 220 and the stay 190 is adjacent an opposite end of the planar section 220. An outer perimeter 222 of the planar section 220 defines a surface area 224. The planar section 220 has an inner surface 226 (which is part of the inner surface 192 of the body 182) spaced from the outer surface 138 of the connection pipe 112 to define a gap 230 there between. A separate reinforcement 236 is mounted to the planar section 220 of the second heat insulating cover 136. According to one aspect, the reinforcement 236 is defined by a plate-shaped body 240 having a first end portion 242, a second end portion 244 and opposite side portion 246, 248 interconnecting the first and second end portions. The body 240 has a thickness greater than a thickness of the planar section 220, thereby providing added strength and rigidity to the planar section 220. In the illustrated embodiment, the reinforcement 236 is dimensioned to be confined in or bounded by the surface area 224 defined by the planar section 220 such that an inner surface 250 of the reinforcement body 240 is entirely in direct contact with the planar section 220. Further, as depicted, the reinforcement 236 can be generally oblong in shape, and according to one aspect, the reinforcement 236 can be ovoid in shape along a plane orthogonal to a longitudinal axis of the reinforcement.

Figure 4:
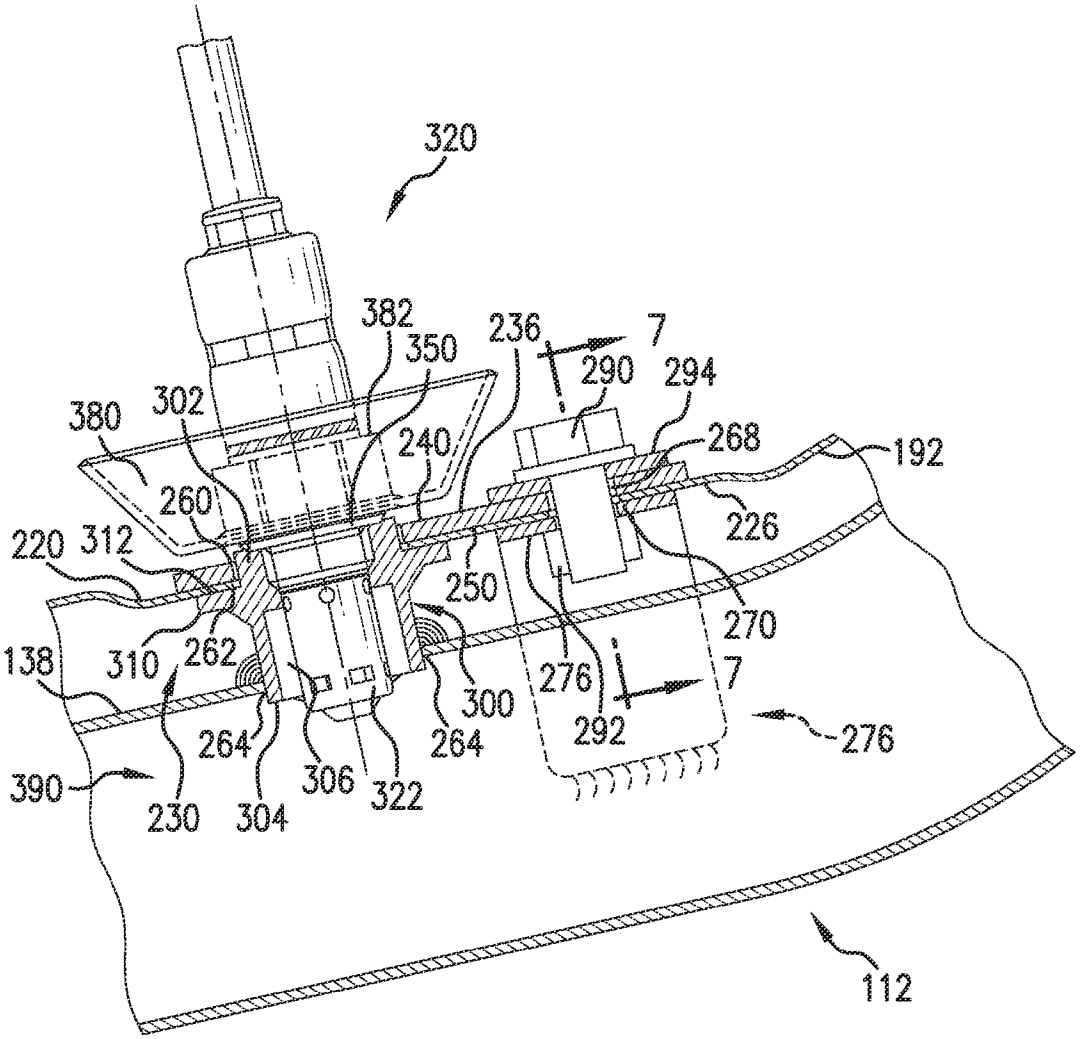
FIG. 4 is a partial cross-sectional view of the vehicle exhaust system of FIG. 2.
Figure 7:
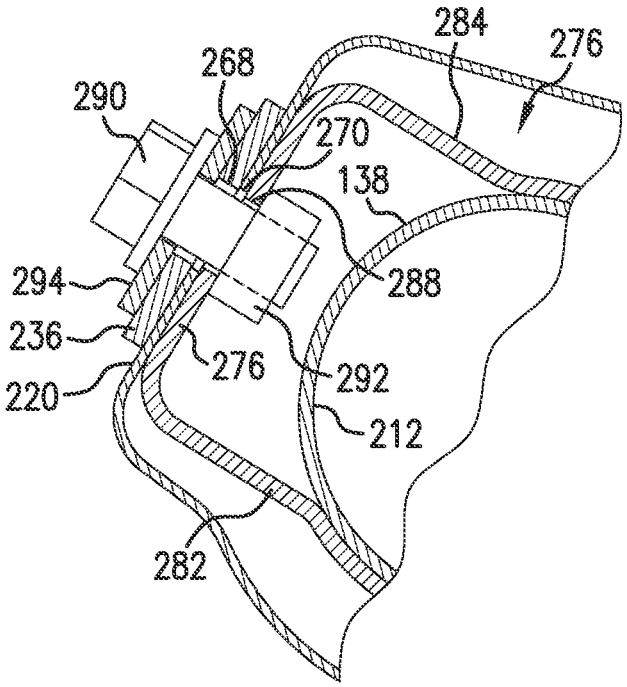
FIG. 7 is a cross-sectional view taken along line 7-7 of the vehicle exhaust system of FIG. 2.

The reinforcement 236 includes an first aperture 260 aligned with both a first hole 262 located in the planar section 220 and an opening 264 located in the outer surface 138 of the exhaust connection pipe 112. The reinforcement 236 includes a second aperture 268 aligned with a second hole 270 located in the planar section 220. As depicted in FIGS. 4 and 7, an attachment fixture or supporting bracket 276 is connected to the outer surface 138 of the connection pipe 112. The supporting bracket 276 includes a top wall 276 and sidewalls 282, 284 extending downwards from both ends of the top wall 276. An end portion of each of the sidewalls can be arched to press against and facilitate attachment to the outer surface 138 of the connection pipe 112. An opening 288 is located in the top wall 276 and is aligned with the second hole 270. To attach the reinforcement 236 to the planar section 220, the first aperture 260, which is dimensioned smaller than the first hole 262, is aligned with the first hole 262. The second aperture 268 is then aligned with the second hole 270, and according to one aspect, the second aperture 268 can be slotted which allows for adjustment and proper alignment of the second aperture 268. Each of the second aperture 268, second hole 270 and bracket opening 288 is dimensioned to receive a fastener 290 which secures the reinforcement 236 to both the planar section 220 and supporting bracket 276. In the depicted embodiment, the fastener 290 is a bolt for fixing the reinforcement plate 236 to the planar section 220 and supporting bracket 276 by screwing into a nut 292 attached to the supporting bracket 276. Also shown is a washer 294 beneath the bolt for reducing friction thereby allowing for a more accurate torque setting.

As shown in FIG. 4, a mounting boss 300 is provided in the gap 230 between the planar section 220 and the outer surface 138 of the connection pipe 112. The mounting boss is in direct contact with the inner surface 226 of the planar section 220 and thereby interconnects the heat insulating cover 136 and the outer surface 138. The mounting boss 300 includes a first end portion 302 and a second end portion 304 opposite the first end portion. A bore 306 extends between the first and second end portions 302, 304. The bore 306 is aligned with the first hole 262 of the planar section 220, and the first end portion 302 projects through the first hole 262. In the assembled condition, the first end portion 302 also projects through the first aperture 260 of the reinforcement 236. And, as indicated previously, because the first aperture 260 is dimensioned smaller than the first hole 260, the first aperture 260 can define a locating or alignment feature for mounting of the second heat insulating cover 136 to the exhaust pipe 112. The first end portion 302 includes annular flange 310 sized to surround both a first hole 262 and the first aperture 260 located in the reinforcement 236. A surface 312 of the annular flange 310 is in direct contact with and extends parallel to the inner surface 226 of the planar section 220 to define a continuous metal to metal contact between the inner surface 226 and the mounting boss 300 and this continuous contact forms a metal to metal mechanical seal. The second end portion 304 of the mounting boss 300 is dimensioned to be received in the opening 264 located in the outer surface 138 of the connection pipe 112. As depicted, the second end portion 304 is fixedly and nonremovably attached (e.g., by welding) to the outer surface 138 to prevent inadvertent movement of the mounting boss 300 in the gap 230.

Figure 3:
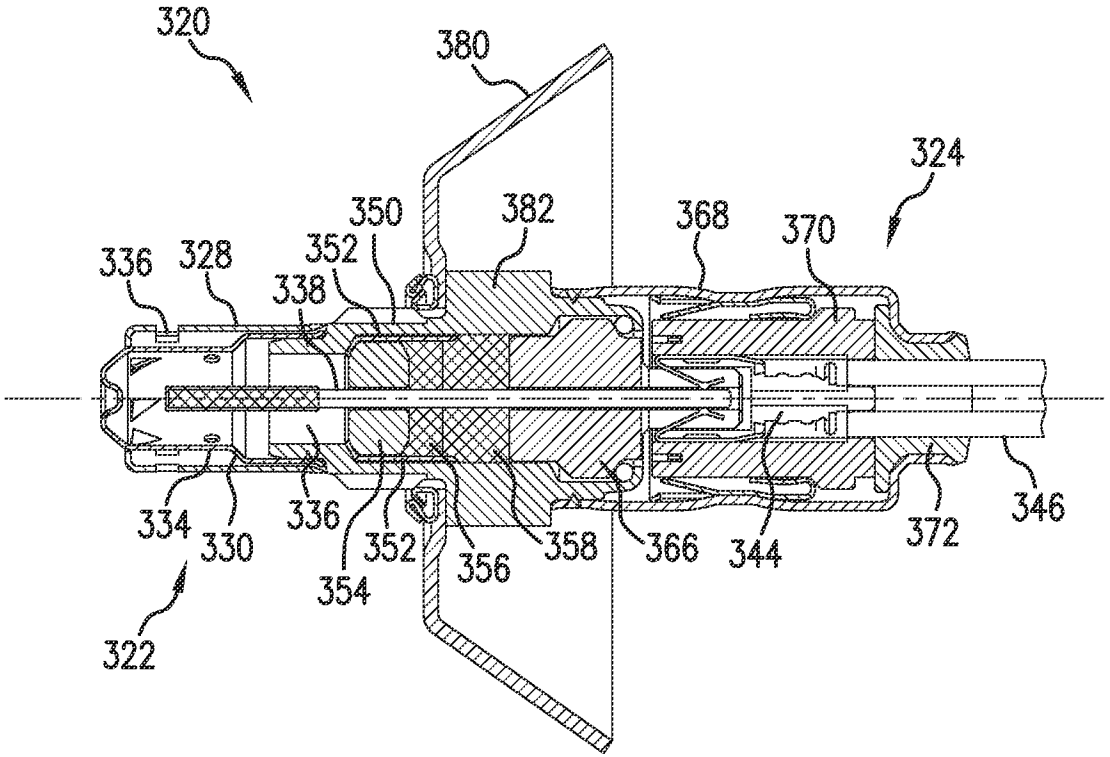
FIG. 3 is a cross-sectional view of an exhaust constituent sensor of the vehicle exhaust system of FIG. 1.

With reference to FIGS. 1, 2 and 3, an exhaust constituent sensor 320 (e.g., an oxygen sensor) is releasably mounted to the exhaust pipe 112. In the depicted embodiment, the sensor 320 is only mounted to the mounting boss 300 and spaced from (i.e., not in direct contact with) the second heat insulating cover 136 and the reinforcement 236. By having the sensor 320 spaced from the heat insulating cover 136, the sensor 320 does not have an impact on the retention of the heat insulating cover 136 on the exhaust pipe 112. Further, by not using the exhaust constituent sensor 320 as a means for retaining the second heat resistant cover 136 to the exhaust pipe 112, the holding and sealing functions of the sensor 320 are not compromised. According to one aspect, the exhaust constituent sensor 320 includes a distal end portion 322 and a proximal end portion 324. The distal end portion 322 has an outer protection tube 328 surrounding an inner protection tube 330. The outer and inner protection tubes form vents 332, 334 for allowing passage of exhaust gas in and out of a sensing chamber 336 so that the gasses may be sensed by a sensing element 338. The sensing element 334 extends from the distal end portion 322 and is electrically connected to terminals 344 located at the proximal end portion 324. The terminals are electrically connected to a wiring harness 346. The outer protection tube 332 is engaged to a shell 350 which houses a cup 352 for a ceramic holder 354. The shell 350 further houses sealing powders 356, 358 located adjacent the ceramic holder 354 and sleeve holder 366. As shown, the sensing element 334 extends through the ceramic holder 354, the sealing powders 356, 358 and the ceramic holder 354. A pipe 368 connected to the shell 350 houses a separator 370 which encloses the terminals 344 and an elastomeric cap 372 through which the wiring harness 346 extends seals the pipe. An annular heat fin or collar 380 is connected to an outer surface of the shell 350. The collar 380 is flared toward the proximal end portion 324 of the exhaust constituent sensor 320. A hex 382 is located in the collar 380. It should be appreciated that the above features of the exhaust constituent sensor 320 are by way of example only and that exhaust constituent sensors having alternative configurations can be used with the exhaust system 100.

As depicted in FIG. 4, in the assembled condition of the exhaust system 100, the distal end portion 322 of the exhaust constituent sensor 320 is received in the bore 306 of the mounting boss 300 (e.g., screwed into the mounting boss 300) and projects through the opening 264 in the outer surface 138 of the exhaust connection pipe 112 and into a passage 390 of the connection pipe. As indicated previously, the direct contact of the annular flange 310 of the mounting boss 300 with the inner surface 226 of the planar section 220 forms the metal to metal mechanical seal. The mechanical seal prevents high temperature air from around the exhaust connection pipe 112 from flowing out of the first hole 262 of the planar section 220 toward the proximal end portion 324 of the exhaust constituent sensor 320. Further, the mechanical seal blocks heat transfer by convection to the proximal end portion 324 of the exhaust constituent sensor and instead transfers heat generated by the connection pipe 112 by conduction to the second heat insulating cover 136. The heat insulating cover 136 acts as a heat sink absorbing and dissipating the transferred heat into an associated surrounding environment. The shell 350 directly engages the mounting boss 300 and is adapted to seal off the bore 306 of the mounting boss 300. The annular collar 380 is spaced above the reinforcement 236 for dissipating heat within the exhaust constituent sensor 320 via thermal convection. It should be appreciated that the heat collar 380 is located at a position where higher temperatures are present so that excessive heat is transferred to heat collar 380 and dissipated before the excessive heat is permitted to contact the electrical connection at the proximal end portion 324 of the exhaust constituent sensor 320.

As is evident form the forgoing, the configuration of the mounting boss 300 and the manner of securing the exhaust constituent sensor 320 to the exhaust pipe 112 eliminate the heat transfer to the exhaust constituent sensor 320 from convection. The direct contact between the mounting boss 300 and the inner surface 226 of the planar section 220 of the heat insulating cover 136 defines the metal to metal mechanical seal that prevents hot air from around the exhaust pipe 112 from flowing out near the exhaust constituent sensor 320.

This reduces to the heat transfer by convection to the wiring harness 346 leading away from the exhaust constituent sensor 320. Furthermore, the metal to metal contact between the heat insulating cover 136 and the mounting boss 300 (via the planar section 220) promotes heat transfer by conduction, thus utilizing the surface area of the planar section 220 as a heat sink. Also, the heat collar 380 mounted to the exhaust constituent sensor 320 provides additional protection from heat transfer from convection.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An exhaust system for a vehicle comprising:

an exhaust pipe having an outer surface;

a heat insulating cover mounted to the exhaust pipe and configured to at least partially surround the outer surface of the exhaust pipe, the cover including a body having a planar section defining a surface area, the planar section having an inner surface spaced from the outer surface of the exhaust pipe to define a gap there between;

a reinforcement separate from the cover and mounted to an outer surface of the planar section of the cover body and wherein the reinforcement is confined in the surface area defined by the planar section;

a mounting boss provided in the gap and in direct contact with the inner surface of the planar section; and an exhaust constituent sensor releasably mounted to the exhaust pipe, a distal end portion of the exhaust constituent sensor being received in the mounting boss and projecting through an opening in the outer surface of the exhaust pipe and into a passage of the exhaust pipe, wherein the direct contact of the mounting boss with the inner surface of the planar section forms a mechanical seal preventing high temperature air from around the exhaust pipe from flowing toward a proximal end portion of the exhaust constituent sensor.

2. The exhaust system of claim 1, wherein the mechanical seal blocks heat transfer by convection to the proximal end portion of the exhaust constituent sensor.

3. The exhaust system of claim 2, wherein the mechanical seal transfers heat generated by the exhaust pipe by conduction to the planar section of the heat insulating cover, the heat insulating cover acting as a heat sink absorbing and dissipating the transferred heat into an associated surrounding environment.

4. The exhaust system of claim 3, wherein the mounting boss includes a first end portion and a second end portion opposite the first end portion, the first end portion including an annular flange in direct contact with the inner surface of the planar section.

5. The exhaust system of claim 4, wherein the second end portion of the mounting boss is dimensioned to be received in the opening located in the outer surface of the exhaust pipe.

6. The exhaust system of claim 4, wherein the second end portion is fixedly and nonremovably attached to the outer surface of the exhaust pipe.

7. The exhaust system of claim 1, wherein the reinforcement is plate shaped having an inner surface entirely in direct contact with the outer surface of the planar section of the cover.

8. The exhaust system of claim 1, wherein the reinforcement includes an aperture dimensioned to receive therein an end portion of the mounting boss, the aperture defining an alignment feature for mounting of the heat insulating cover to the exhaust pipe.

9. The exhaust system of claim 1, wherein the planar surface of the heat insulating cover includes a first hole aligned with the opening located in the outer surface of the exhaust pipe and a second hole, and the exhaust system further includes a supporting bracket connected to the outer surface of the exhaust pipe and having an opening aligned with the second hole, each of the second hole and bracket opening dimensioned to receive a fastener which attaches the heat insulating cover to the supporting bracket.

10. The exhaust system of claim 1, wherein the exhaust constituent sensor is only mounted to the mounting boss and is not in direct contact with the heat insulating cover.

11. An exhaust system for a vehicle comprising:

an exhaust pipe having an outer surface;

a heat insulating cover mounted to the exhaust pipe and configured to at least partially surround the outer surface of the exhaust pipe; and a mounting boss interconnecting the heat insulating cover and the outer surface of the exhaust pipe, the mounting boss including a first end portion and a second end portion, the first end portion having an annular flange in direct contact with an inner surface of the cover and surrounding a hole located in the cover, the second end portion received in an opening located in the outer surface of the exhaust pipe, wherein the direct contact of the annular flange with the inner surface forms a metal to metal mechanical seal between the mounting boss and the heat insulating cover, the mechanical seal transferring heat generated by the exhaust pipe by conduction to the heat insulating cover, the heat insulating cover acting as a heat sink absorbing and dissipating the transferred heat into an associated surrounding environment.

12. The exhaust system of claim 11, further including an exhaust constituent sensor having distal end portion received in the mounting boss and projecting through the opening and into a passage defined by the exhaust pipe, wherein the mechanical seal prevents high temperature air from around the exhaust pipe from flowing out of the cover hole toward a proximal end portion of the exhaust constituent sensor and blocks heat transfer by convection to the proximal end portion of the exhaust constituent sensor.

13. The exhaust system of claim 12, further including a separate reinforcement positioned between the sensor and the heat insulating cover, the reinforcement having an aperture dimensioned to receive therein the first end portion of the mounting boss, wherein the aperture of the reinforcement is dimensioned smaller than the hole of the heat insulating cover and defines an alignment feature for mounting of the heat insulating cover to the exhaust pipe.

14. The exhaust system of claim 13, further including a supporting bracket connected to the outer surface of the exhaust pipe, both the reinforcement and the heat insulating cover being fastened to the supporting bracket.

15. The exhaust system of claim 13, wherein the heat insulating cover includes a planar section defining a surface area, and the reinforcement is mounted to the planar section and bounded by the surface area.

16. The exhaust system of claim 12, wherein the sensor is mounted only to the mounting boss.

17. An exhaust system for a vehicle comprising:

a heat insulating cover mounted to an exhaust pipe;

a cylindrical shaped mounting boss located between an inner surface of the cover and an outer surface of the exhaust pipe, the mounting boss including a first end portion received in a hole located in the cover and having an annular flange in direct contact with the inner surface of the cover and a second end portion opposite the first end portion and received in an opening located in the outer surface of the exhaust pipe; and an exhaust constituent sensor mounted directly to the mounting boss, wherein a surface of the annular flange in direct contact with the inner surface of the heat insulating cover extends parallel to the inner surface to define a continuous metal to metal contact such that the annular flange prevents a flow of high temperature air generated by the exhaust system toward the exhaust constituent sensor, the annular flange further transferring heat generated by the exhaust pipe by conduction to the heat insulating cover, the heat insulating cover acting as a heat sink absorbing and dissipating the transferred heat into an associated surrounding environment.

18. The exhaust system of claim 17, wherein the second end portion of the mounting boss is fixedly and nonremovably attached to the outer surface of the exhaust pipe.

19. The exhaust system of claim 18, further including a separate reinforcement mounted to the heat insulating cover, the reinforcement having an aperture dimensioned to receive therein the first end portion of the mounting boss, and a supporting bracket located between the inner surface of the heat insulating cover and the outer surface of the exhaust pipe, the reinforcement being fastened to the supporting bracket.

* * * * *